United States Patent [19]

Reinehr et al.

[11] Patent Number: 4,854,021

[45] Date of Patent: Aug. 8, 1989

[54] STUFFERBOX CRIMPER AND PROCESS FOR PREPARING CRIMPED SYNTHETIC FIBERS

[75] Inventors: Ulrich Reinehr, Dormagen; Christian Pieper, Neuss; Rolf-Burkhard Hirsch, Dormagen; Hermann-Josef Jungverdorben, Dormagen; Jakob Breuer, Dormagen, all of Fed. Rep. of Germany

[73] Assignee: Hoechst Aktiengesellschaft, Fed. Rep. of Germany

[21] Appl. No.: 93,735

[22] Filed: Sep. 8, 1987

[30] Foreign Application Priority Data

Sep. 19, 1986 [DE] Fed. Rep. of Germany ..... 3631905

[51] Int. Cl.[4] ..... D02G 1/12

[52] U.S. Cl. ..... 28/263

[58] Field of Search ..... 28/262, 263, 268, 269

[56] References Cited

U.S. PATENT DOCUMENTS

| | | | |
|---|---|---|---|
| 3,516,241 | 6/1970 | Nakano et al. | 28/269 X |
| 4,597,142 | 7/1986 | Bauch et al. | 28/269 |

FOREIGN PATENT DOCUMENTS

| | | | |
|---|---|---|---|
| 110471 | 4/1964 | Czechoslovakia | 28/263 |
| 924751 | 3/1947 | France | 28/269 |
| 46864 | 1/1971 | Japan | 28/263 |
| 1057417 | 2/1967 | United Kingdom | 28/263 |

OTHER PUBLICATIONS

Peters, Application Ser. No. 753,132, filed 08/16/1968, Laid open to public inspection on Apr. 15, 1969 as noted at 861 O.G. 705.

*Primary Examiner*—Robert R. Mackey

*Attorney, Agent, or Firm*—Connolly and Hutz

[57] ABSTRACT

In an improved crimping process, use is made of a stufferbox where (a) lid and/or floor are arranged movably and (b) in the working position, the distance between lid and floor at the inlet opening is smaller than the distance between lid and floor at the outlet opening.

3 Claims, 1 Drawing Sheet

STUFFERBOX CRIMPER AND PROCESS FOR PREPARING CRIMPED SYNTHETIC FIBERS

BACKGROUND OF THE INVENTION

The invention relates to a process for preparing crimped synthetic fibers by the compressive crimping process, in particular for acrylic fibers, and to an apparatus for carrying out the process. In particular, the invention relates to a process for continuous compressive crimping during a continuously running fiber spinning and aftertreatment process involving high tow weights above 100,000 dtex and production speeds above 200 m/min.

Processes and apparatuses for crimping synthetic fibers are known. With the most preferred form of compressive crimping, the tow is passed through two guide rolls into a crimping box where the tow accumulates and is kept back under pressure, the tow becoming folded in small zigzags to form the so-called crimp. Three of the four walls of the crimping box are fixed, while the fourth wall is formed by a movable plate on which pressure can be imposed. When the internal pressure of the crimped tow has become equal to the pressure which prevails on said movable plate, the plate is forced upward and the compressed tow leaves the box through the slot formed in this way.

It has now been found that the previously disclosed processes and apparatuses of this kind have the disadvantage, in particular in the crimping of acrylic tows, that they can only be used for crimping tows at production speeds up to about 150–200 m/min. At higher speeds, above about 200 m/min, acrylic tows tend to become compacted. The reason for that is that, at high speeds and high tow weights as occur chiefly in continuous spinning and aftertreatment processes as described, for example, in EP-A No. 98,477, large amounts of fiber accumulate in the stufferbox within a very short time and their pent-up kinetic energy must be dissipated to avoid compacting. There has been no shortage of attempts to take account of this fact, for example by cooling the intake rolls, by guiding the crimped tow in a specific way (DE-A No. 1,435,438) or by wetting the tow with moisture (U.S. Pat. No. 3,041,705). By cooling and specific tow guidance in the stufferbox alone, however, it is impossible to achieve high production speeds as occur in continuous spinning and aftertreatment processes. In addition, the compressive crimping of moist acrylic tows has the disadvantage that the crimp is very unstable and frequently leads to so-called hack points during compressive crimping. Hack points are to be understood as meaning crimping damage in the tow which leads to holes in the crimped filament assembly and gives rise to staple length shortening and short fibers.

SUMMARY OF THE INVENTION

It was therefore the object of the present invention to provide a continuous compressive crimping process, in particular for acrylic tows of high weights, preferably above 100,000 dtex, for high production speeds, chiefly greater than 200 m/min, and an apparatus for carrying out the process.

There has now been found a process for crimping synthetic fibers with a stufferbox crimper which comprises an inlet opening, a stufferbox with floor, lid and side parts, and an exit opening, characterized in that use is made of a stufferbox where (a) lid and/or floor are arranged movably and (b) in the working position the distance between lid and floor at the inlet opening is smaller than the distance between lid and floor at the outlet opening.

The invention also provides an apparatus for stufferbox crimping synthetic fibers comprising an inlet opening, a stufferbox with floor, lid and side parts, and an exit opening, characterized in that lid and/or floor of the stufferbox are arranged movably and in the working position the distance between lid and floor at the inlet opening is smaller than the distance between lid and floor at the outlet opening.

In a preferred embodiment, the synthetic fibers to be crimped are taken up by a pair of squeeze rolls and shoved into the inlet opening.

In a further preferred embodiment, lid and/or floor are arranged movably about a pivot point near the inlet opening, preferably about the axis of one roll of the pair of squeeze rolls.

In a further preferred embodiment, side walls and lid of the stufferbox are arranged fixedly and the floor movably about the axis of the squeeze roll.

In a particularly preferred embodiment, the stufferbox is dimensioned in such a way that, when lid and floor are in a parallel position, in a stufferbox zone I adjoining the inlet opening there is formed an adjoining stufferbox zone II in which the distance from lid to floor increases in the direction of the outlet opening. Preferably, the lid of stufferbox zone I is at an angle to the lid of stufferbox zone II, while the floor in the two zones is formed by a single plane surface. In a very particularly preferred embodiment, the following applies:

(a) The area $F_2$ of the side parts of stufferbox zone II amounts to at least 85% of the area $F_1$ of the side parts of stufferbox zone I. This percentage share, designated $V_1$, thus amounts to at least 85%.

To describe the complex crimping processes in the compressive crimping of acrylic fibers, in addition to $V_1$ the introduction of the following further product- and process-specific variables have proved appropriate:

(b) The ratio $V_2$ of speed v in (m/min) of the tow fed into the stufferbox to the residence time t (in seconds) of the tow in the stufferbox.

The following ratio applies here:

$$V_2 = \frac{v\ (\text{m/min})}{t\ (\text{sec})} = <100$$

This ratio $V_2$ represents a so-called acceleration factor and says something about the crimpability of acrylic fibers. At production speeds above 200 m/min and tow thicknesses higher than 100,000 dtex, $V_2$ should preferably be smaller than 100 m/min$\times$sec$^{-1}$. If $V_2$ is greater than 100, the crimping box can be too small and lead to compacting of the material. Compacting is to be understood as meaning intermingled and coalesced filaments which, even after cutting and opening up during further processing, for example on carding machines, are no longer satisfactorily separable and lead to bristles and unclean yarns.

(c) The ratio $V_3$ of throughput rate m (measured in g/seconds) of tow through the stufferbox to residence time t (measured in seconds). $V_3$ is preferably smaller than 50 g/sec$^2$. Exceeding the stated limit as a consequence of excessively high throughput on insufficiently long residence time again leads to compacted acrylic tows.

$$V_3 = \frac{m\ (g/sec)}{t\ (sec)} = <50$$

(d) The density δ of the acrylic tows in the stufferbox. The density δ (measured in g/cm³) can be calculated from the ratio of the crimping box contents in grams to the crimping box capacity in cm³.

$$\delta = \frac{\text{crimping box contents (g)}}{\text{crimping box capacity (cm}^3)} = >0.2$$

The density δ, which by definition is to be understood as meaning not the actual substance density of acrylic fibers but the material density of the tow in the stufferbox, likewise says something about the state of crimp of the acrylic tow in the stufferbox. If the density δ is less than 0.2 g/cm³, generally only slightly crimped, virtually smooth tows are present.

In the case of the hitherto disclosed manufacturing processes for acrylic fibers, crimping speeds above 200 m/min are not known. Whereas in wet spinning the spin speed in the coagulation bath is at most about 15 m/min and, after a 1:6 to 1:10 stretch, production speeds of at most 150 m/min are reached, the speed ratios in dry spinning are similar. In dry spinning, spinning takes place on ring dies having a far smaller number of holes than in wet spinning into cells at higher take-off speeds of about 200–300 m/min, the spun material, however, is then first collected in so-called spinning cans and subsequently washed, stretched about 1:4-fold, dried and crimped. The speeds obtained therein are likewise at most 150—about 200 m/min. Higher speeds are inefficient because the rate-determining factor is the rate of solvent removal during the washing of the spun material. Only with the appearance of continuous spinning and aftertreatment processes of dry-spun acrylic tows does it become necessary to match the speed of crimping to the higher production speeds as described for example in EP-A No. 98,477. The compressive crimping process described according to the invention is therefore preferably suitable for continuously dry-spun acrylic tows having higher weights above 100,000 dtex and for production speeds up to about 1500 m/min, preferably 500–1200 m/min.

DETAILED DESCRIPTION OF THE INVENTION

Figure 1:
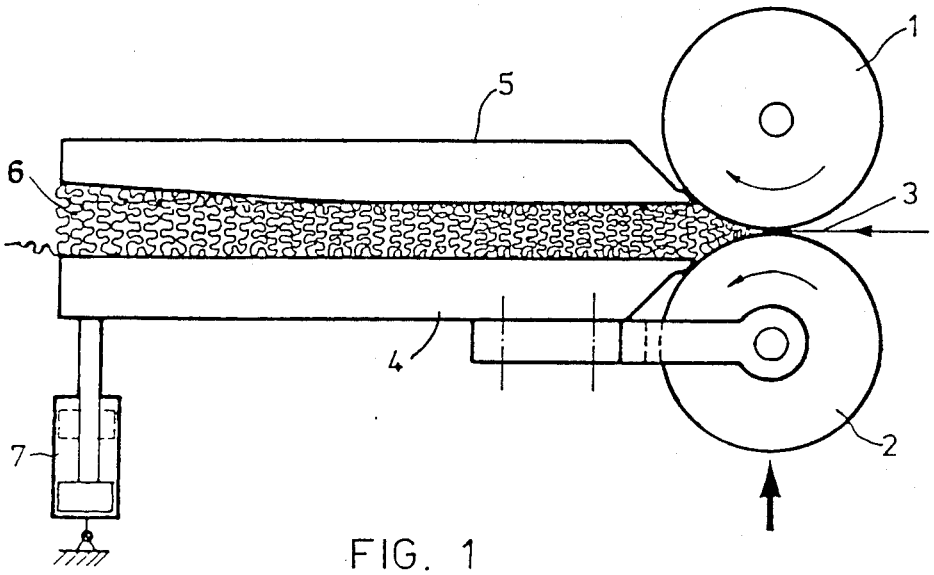
FIG. 1 is a side elevational view of the apparatus of the present invention with the side part removed to show interior detail.

FIG. 1 shows an apparatus according to the invention, comprising a pair of squeeze rolls consisting of rolls (1) and (2), an inlet opening (3), a stufferbox with floor (4), lid (5) and side parts, and an exit opening (6) in the working position. The stufferbox consists in principle of a pair of squeeze rolls consisting of rolls (1) and (2) and a downstream box. The side walls of this box are arranged fixedly, as is box lid (5). The "box floor" (4) is mounted movably. At the end of the box floor there is a pressure cylinder (7) which exerts an adjustable force on the movable plate of the box floor.

Working method:

In the normal state with the crimper in the working position, the exit height of the crimping box is between 40 and 50 mm. The working lift of the pressure cylinder which is attached at the end of the movable plate is thus about 10 mm.

In the working position of the conventional stufferbox crimping process, the distance between lid and floor of the crimping box inlet opening is in general greater than the distance between lid and floor of the exit opening. In the case of the present invention, the upstream crimping box zone works in the same way. The downstream second stufferbox zone II, however is wider in the exit opening between floor and lid than the inlet opening (cf. FIG. 1).

In other words:

In FIG. 1, the (stationary) lid is flattened off in the second stufferbox zone.

In the same way, for example the floor with the movable plate could be flattened off instead of the stationary lid. A further possibility results from applying an adjustable piston force at the chamfered surface with a pivot point at the start of this surface, thereby making the stufferbox crimping process variable within wide limits. It is preferred in every case that the area ratio $V_1$ of $F_2$:$F_1$ is at least 85% and the other stated boundary conditions of $V_2$ smaller than 100, $V_3$ smaller than 50 and the material density δ greater than 0.2 are maintained.

The compressive crimping process according to the invention, however, is not restricted only to a continuous manufacturing process for dry-spun acrylic fibers. In the same way it is possible to use the apparatus described to subject dry- or wet-spun acrylic tows which have been washed and optionally stretched and dried and are present for example in cans to subsequent compressive crimping at speeds above 200 m/min. Other synthetic fibers as well can be subjected to compressive crimping according to the invention, in particular polyester and polyamide fibers. The process according to the invention permits continuous stufferbox crimping at high production speeds, in particular by the continuous processes disclosed for example in EP-A No. 98,477.

The following examples serve to illustrate the invention in more detail without restricting it thereto.

EXAMPLE 1

An acrylic tow which has a total linear density of 626,000 dtex and which has been continuously dry-spun and spin-finished at a take-off speed of 100 m/min is stretched 1:6-fold over hot rolls at a tow temperature of 110° C. and supplied to a stufferbox as per FIG. 1. The preset tow weight was 10.4 g/m and the crimping speed 600 m/min. Crimping was effected with a force of 30 kp on the movable plate together with a force of 1800 kp on the intake rolls. The tow was additionally treated with 10 kg/h of spray steam before entry into the crimping box. The crimping box length was 510 mm, the crimping box width 75 mm and the crimping box height 40 mm. The widened opening, that of the crimping box wall opposite to the movable plate, begins after 290 mm of box length (cf. Figure). The inner opening at the end of the crimping box is 50 mm. The area of the unchanged crimping box zone $F_1$ is 116 cm² and the area of the modified crimping box zone $F_2$ is 99 cm². The intake rolls of the stufferbox are thermostatable with water. The roll temperature was 70° C. The crimped tow is subsequently steamed without tension and cut into staple fibres 60 mm in length. The final linear density of an individual fiber is 2.2 dtex. The crimp contraction of the fibers is 19.5%. The loose fiber has an adhesive force of 68 centi newton/Ktex. The processing speed on a high-performance carding machine is 110 m/min.

The ratio $V_1$ is:

$$V_1 = \frac{F_2 \times 100}{F_1} = \frac{99 \times 100}{116} = 85\%$$

The contents of the compressive crimping box are 820 g. To an acrylic tow having a tow weight of 10.4 g/m, a production speed of 600 m/min produces a throughput of 104 g/second. Accordingly, the residence time in the stufferbox is 820:104=about 7.9 seconds.

The acceleration factor $V_2$ is accordingly:

$$V_2 = \frac{600\ (\text{m/min})}{7.9\ (\text{sec.})} = 76\ \text{m/min} \cdot \text{sec}^{-1};$$

The ratio $V_3$ can be calculated to be:

$$V_3 = \frac{104\ (\text{g/sec})}{7.9\ (\text{sec})} = 13.2$$

The material density $\delta$ of the tow in the crimping box is:

$$\delta = \frac{820\ \text{g}}{1612.5\ (\text{cm}^3)} = 0.51\ \text{g/cm}^3$$

EXAMPLES 2–12

The table below gives further examples of compressive crimping of acrylic tows using differently dimensioned compressive crimping apparatuses for different tow weights and crimping speeds up to 1200 m/min. Furthermore, the values of the corresponding crimp parameters and the assessment of the crimp are given.

Example 2 shows that even high tow weights of for example 25 g/m, corresponding to 250,000 dtex, can be subjected to compressive crimping by the process according to the invention.

Example 3 says that the material can become compacted at an acceleration factor $V_2$ of greater than 100.

In Example 4 it is shown that the area ratio $V_1$ should preferably be greater than 85% since otherwise the pent-up kinetic energy in the unchanged crimping box zone can become too high and the material undergoes felting.

Example 5 shows that by enlarging the area proportion of $F_2$ it is possible to restore satisfactory compressive crimping.

In Example 6, it is shown that at low crimping box fillage and hence low material density in the crimping box only smooth fibres are obtained in certain circumstances.

Example 7 shows that if the limits for the parameters $V_2$ and $V_3$ are not complied with the acrylic tow can become compacted.

In Examples 8–10, it is shown that by appropriately dimensioning the crimping box even high tow weights can be put through satisfactory compressive crimping according to the inventive process at very high crimping speeds.

In Examples 11 and 12, finally, it is shown that the compressive crimping process of the present invention can also be successfully applied to smaller tow weights below 100,000 dtex.

In the examples, part of the assessment of the crimp was derived on the basis of the crimp contraction of the tow determined in accordance with:

$$E_{Kr} = \frac{1g - 1z}{1g} \times 100\ (\text{in } \%)$$

(cf. Riggert: Crimp of manmade staple fibres and tows and its significance for further processing [in German] in Melliand Textilberichte 4/1977, page 274).

In the equation:

1 g=length of stretched, crimp-removed state 1 z=length of contracted, crimped state For polyacrylonitrile fibers of the wool type, crimp contraction is normally about 15–22% (cf.: Riggert Melliand Textilberichte 4/1977, Table 1, page 278).

Further assessment criteria used were the adhesive force (measured in cN/Ktex) and the processing speed of crimped staple fibers on a high-performance carding machine (measured in m/min).

TABLE

| Example No. | | 2 | 3 | 4 | 5 | 6 | 7 | 8 | 9 | 10 | 11 | 12 |
|---|---|---|---|---|---|---|---|---|---|---|---|---|
| Crimp.box length | mm | 510 | " | " | " | " | 365 | 750 | " | 1500 | 165 | " |
| Crimp.box width | mm | 75 | " | " | " | " | 25 | 75 | " | 75 | 25 | " |
| Crimp.box height | mm | 40 | " | " | " | " | 45 | 40 | " | 40 | 40 | " |
| Crimp.box wall unchanged | mm | 290 | " | 300 | 280 | 290 | 200 | 400 | " | 800 | 90 | " |
| Crimp.box wall modified | mm | 220 | " | 210 | 230 | 220 | 165 | 350 | " | 700 | 75 | " |
| Opening at crimp.box end | $cm^2$ | 50 | " | " | " | " | 55 | 50 | " | 50 | 45 | " |
| Area $F_1$ of crimp.box unchanged | $cm^2$ | 116 | " | 120 | 112 | 116 | 90 | 160 | " | 320 | 36 | " |
| Area $F_2$ of crimp.box changed | $cm^2$ | 99 | " | 94.5 | 103.5 | 99 | 82.5 | 157.5 | " | 315 | 31.9 | " |
| Force on movable plate | Kp | 120 | 100 | 30 | 50 | 40 | 220 | 80 | 100 | 60 | 60 | 40 |
| Roll force | Kp | 1800 | " | " | " | 1400 | 1400 | 1800 | " | 1800 | 1200 | " |
| Crimp.box contents | g | 820 | " | " | " | 300 | 500 | 1250 | " | 2500 | 140 | " |
| Tow weight | g/m | 25.0 | 10.4 | 10.4 | " | " | 24.0 | 10.4 | 20.0 | 10.0 | 4.0 | 2.0 |
| Crimping speed | m/min | 250 | 800 | 600 | " | 400 | 465 | 800 | 600 | 1200 | 400 | " |
| Throughput | g/sec | 104 | 139 | 104 | " | 69.3 | 186 | 139 | 200 | 200 | 26.7 | 13.3 |
| Residence time in crimp.box | sec | 7.9 | 5.9 | 7.9 | " | 4.3 | 2.7 | 9.0 | 6.3 | 12.5 | 5.2 | 10.5 |
| $V_1$ $F_2/F_1 \times 100\%$ | | 85 | 85 | 79 | 92 | 85 | 92 | 98 | 98 | 98 | 89 | 89 |
| $V_2$ m/min $sec^{-1}$ | | 32 | 136 | 76 | 76 | 9.3 | 172 | 88.9 | 95.2 | 96 | 76.9 | 38.1 |
| $V_3$ g/$sec^2$ | | 13.2 | 23.6 | 13.2 | 13.2 | 16.1 | 68.9 | 15.4 | 31.7 | 16 | 26.9 | 13.3 |
| Density $\delta$g/$cm^3$ | | 0.51 | 0.51 | 0.51 | 0.51 | 0.19 | 1.22 | 0.52 | 0.52 | 0.52 | 0.82 | 0.82 |
| State of crimp | | satis-factory | com-pacted | com-pacted | satis-factory | smooth fibers | com-pacted | satis-factory | satis-factory | satis-factory | satis-factory | satis-factory |

TABLE-continued

| Example No. | | 2 | 3 | 4 | 5 | 6 | 7 | 8 | 9 | 10 | 11 | 12 |
|---|---|---|---|---|---|---|---|---|---|---|---|---|
| Crimp contraction | % | 18.9 | | | 20.1 | | | 19.1 | 18.3 | 16.7 | 20.3 | 18.1 |
| Adhesive force | cN/ktex | 62 | | | 67 | | | 54 | 57 | 50 | 71 | 55 |
| Carding machine | m/min | 100 | | | 100 | | | 90 | 100 | 80 | 120 | 100 |

We claim:

1. An apparatus for crimping acrylic fiber tows having high tow weights above 100,000 dtex and production speeds above 200 m/min comprising a stufferbox without heating means and a pair of feed rollers constructed and arranged to feed fiber tows into the stufferbox, the stufferbox including a floor, a lid and opposed side walls, the stufferbox having an inlet opening and an unobstructed outlet opening larger than the inlet opening, pivot mounting means near the inlet opening whereby at least one of the lid and floor is movable relative to the other, the floor, lid and opposed side walls of the stufferbox defining a first zone adjacent the inlet opening and a second zone extending downstream therefrom, and the stufferbox having dimensions whereby the lid and floor are generally parallel to one another in the first zone and the lid and floor gradually move apart from one another in the second zone up to the unobstructed outlet opening.

2. An apparatus as in claim 1 wherein the floor of the stufferbox has a single planar surface, and lid has a first planar surface in the first zone and second planar surface in the second zone angled to the first surface.

3. A process for crimping acrylic fiber tows having high weights above 100,000 dtex with an apparatus comprising a pair of feed rollers and a stufferbox having a floor, lid and opposed walls that define an inlet opening and an unobstructed outlet opening, introducing the acrylic fiber tows into the stufferbox at a rate of at least 200 m/min, moving at least one of the lid and floor toward one another about a pivot point near the inlet opening while the opposed side walls are fixed, moving the acrylic fiber tow through a first zone in the stufferbox adjoining the inlet opening, and then through a second adjoining stufferbox zone, the lid and floor being generally parallel to one another in the first zone and the distance from the lid to the floor in the second zone gradually increasing in the direction of the unobstructed outlet opening, in the working position of the stufferbox the distance between the lid and floor being smaller at the inlet opening than the distance between the lid and floor at the unobstructed outlet opening, the area of the side walls of the second stufferbox zone amounting to at least 85% of the area of the side walls of the first stufferbox zone, and the floor in the two stufferbox zones being planar, the acceleration factor $V_2$ formed from the ratio of the two speed v (m/min) with a residence time t(sec) in the crimping box being less than 100, the ratio $V_3$ of throughout weight m (g/sec) and residence time t(sec) being smaller than 50, and wherein the material density is $$\frac{\text{crimping box contents (g)}}{\text{crimping box capacity (cm}^3\text{)}}$$

and is greater than 0.2.

* * * * *

UNITED STATES PATENT AND TRADEMARK OFFICE

CERTIFICATE OF CORRECTION

PATENT NO. : 4,854,021

DATED : August 8, 1989

INVENTOR(S) : Reinehr et al

It is certified that error appears in the above-identified patent and that said Letters Patent is hereby corrected as shown below:

FRONT PAGE:

"[73] Assignee: Hoechst Aktiengesellschaft, Fed. Rep. of Germany" should read

-- [73 Assignee: Bayer Aktiengesellschaft, Fed. Rep. of Germany --.

Signed and Sealed this

First Day of January, 1991

*Attest:*

HARRY F. MANBECK, JR.

*Attesting Officer*

*Commissioner of Patents and Trademarks*